United States Patent [19]

Schmidt et al.

[11] Patent Number: 4,715,586

[45] Date of Patent: Dec. 29, 1987

[54] CONTINUOUS CASTER TUNDISH HAVING WALL DAMS

[75] Inventors: Manfred Schmidt, Bethlehem, Pa.; Theodore W. Fenicle, Chesterton, Ind.

[73] Assignee: Bethlehem Steel Corporation, Bethlehem, Pa.

[21] Appl. No.: 16,913

[22] Filed: Feb. 18, 1987

[51] Int. Cl.[4] ..... B22D 11/10; B22D 41/02; B22D 41/08

[52] U.S. Cl. ..... 266/275; 164/437; 222/591

[58] Field of Search ..... 164/437, 489, 488; 222/594, 591, 590, 606; 266/275, 229, 280, 283

[56] References Cited

U.S. PATENT DOCUMENTS 4,177,855 12/1979 Duchateau et al. ..... 164/437 X 4,632,368 12/1986 Podrini ..... 266/275 X

FOREIGN PATENT DOCUMENTS 2555286 6/1977 Fed. Rep. of Germany ..... 164/437

55-86662 6/1980 Japan ..... 164/437

59-197358 11/1984 Japan ..... 222/591

1536175 12/1978 United Kingdom ..... 164/437

*Primary Examiner*—Gene P. Crosby

*Assistant Examiner*—J. Reed Batten, Jr.

*Attorney, Agent, or Firm*—William B. Noll; John I. Iverson

[57] ABSTRACT

A continuous caster tundish having refractory wall dams formed as part of a portion of the lining of the interior of the side walls, where each refractory wall dam is characterized by a flange projecting substantially horizontally inwardly to prevent turbulent surface flow as molten metal is poured into the tundish.

2 Claims, 4 Drawing Figures

FIG. 1
PRIOR ART
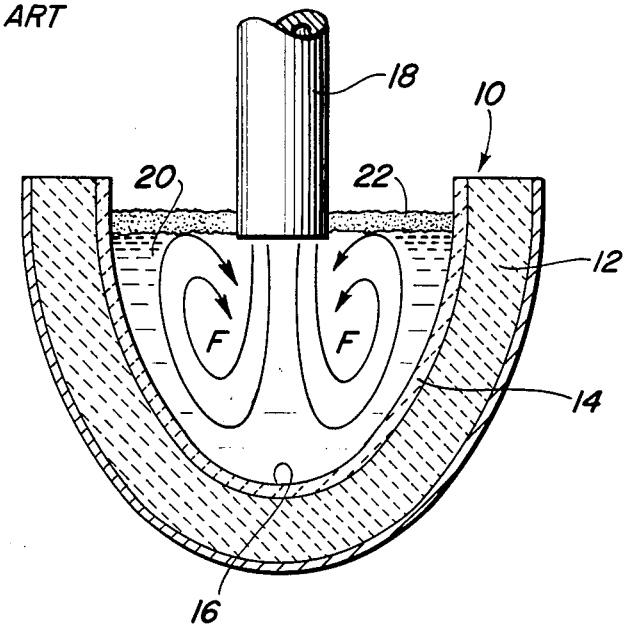
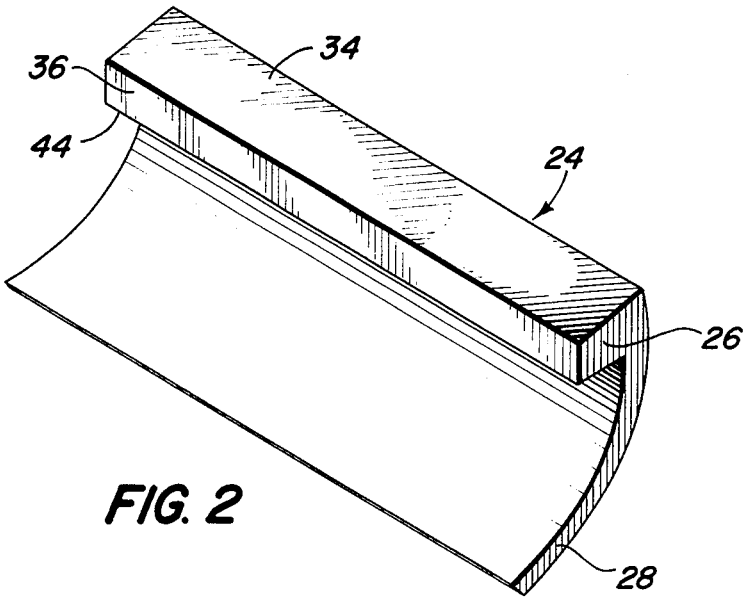
FIG. 2

CONTINUOUS CASTER TUNDISH HAVING WALL DAMS

BACKGROUND OF THE INVENTION

This invention is directed to a new construction for a tundish used in the continuous casting of molten metal, such as for example in the production of steel.

A continuous steel caster is a machine that transforms or casts molten steel into solidified semi-finished shapes such as billets, blooms and slabs. Specifically, molten steel from a steelmaking furnace, usually a basic oxygen furnace, is poured from a ladle through a ceramic shroud into a trough-shaped container or vessel called a tundish, which functions as a continuous reservoir for the mold, as discussed hereinafter. The walls of the tundish consist of a steel shell that has been lined with a refractory material, a portion of which is replaced after each use of the tundish. Specifically, the tundish is lined with a permanent lining that is replaced after approximately 500 casts. Additionally, there is a replaceable lining that is replaced after each cast.

In the operation of the caster, molten steel from the reservoir of steel in the tundish is then poured into a device which sizes and shapes the steel, this is known as the caster mold. As the partially solidified steel emerges from the mold, the steel is in the form of a strand and is moved through cooling devices by an array of motorized rollers. Thus, a continuous supply of molten steel from the tundish to the caster mold will allow steel to be cast without interruption.

In order to protect the molten steel in the tundish, a flux/slag layer thereover is provided for a multiplicity of purposes. For example, such layer functions to (1) maintain the temperature of the molten steel which is typically about 2800° F., (2) protect the molten steel against excessive oxidation, and (3) scavenge undesirable elements from the molten steel.

One problem that arises when molten steel is poured from the ladle into the tundish is that the molten steel rebounds against the tundish bottom and travels in an upward direction along the lining of the tundish walls creating a turbulent flow pattern on the surface of the molten steel bath in the area around the shroud. One of the undesirable effects created by this turbulent flow is that the slag and flux covering the molten steel bath are dispersed. As a result, a portion of the molten steel bath in the area around the shroud becomes exposed to the ambient atmosphere and interacts with oxygen creating inclusions in the molten steel, which may be entrapped and carried over into the solidified steel.

In an attempt to eliminate the undesirable effects created by such turbulent flow, several proposed solutions have been considered. One possible solution involves adding more flux to the molten steel bath in order to prevent the molten steel from becoming exposed to the ambient atmosphere in the area around the shroud. Although additional flux may prevent such exposure, it has also been found that adding more flux causes some of the flux to become entrained in the molten steel, i.e., the flux becomes a part of the molten steel as it is poured into the caster mold and will remain in the molten steel during the solidification process. Another proposed solution was to enclose completely the region above the molten steel bath in the caster tundish and provide an inert gas environment in the enclosed area. Although this eliminates the need for the use of fluxes, the procedure can be technically difficult to use and maintain, and cannot be applied to all tundish designs.

A third possible solution involved the use of elaborate dam and weir systems to reduce the turbulent flow. Such a solution is taught in U.S. Pat. No. 4,177,855. The tundish construction described therein incorporates an impact pad to define the pouring area for the molten metal, and a pair of spaced-apart pivotal refractory, heat-insulating slabs. Such slabs pivot from a generally vertical position at the initiation of the metal pour, and are moved to a horizontal position as the molten metal fills the tundish.

A second type of tundish construction is described in U.S. Pat. No. 4,042,229. The tundish contains a molten metal impact area having a pair of upstanding, spaced-apart beams or weirs. Above such beams, the tundish is provided with a comparable pair of upper beams adjacent the top. As described in such patents, the dams and weirs are oriented in the tundish in a direction transverse to the long axis of the tundish and affect primarily the longitudinal flow of the molten steel into the tundish. The transverse flow of the molten steel is unaffected by these dams and weirs and as a result, the turbulent flow is not eliminated.

Consequently, there is still a need for a tundish which is designed to eliminate the turbulent flow and the undesirable effects created thereby when steel is poured into the tundish. The following specification contains a description of a tundish construction which is effective in achieving the desired result.

SUMMARY OF THE INVENTION

This invention relates to a new tundish design for a continuous caster that eliminates turbulent flow as molten steel is poured therein. Such result is achieved by the use of refractory dams along the side walls of the tundish.

More particularly, such result is realized with a continuous caster tundish having a refractory-lined bottom, two refractory-lined end walls, and two modified side or longitudinal walls, where the side walls are longer than the end walls. The side walls are modified by the incorporation of refractory dams, one along each side, formed as part of the replaceable lining of the side wall. A suitable refractory material often used to form the dam is magnesium oxide. The dam consists of two members attached to each other. One of the members is essentially a flange which projects substantially horizontally inwardly from the side wall, and a second member substantially parallel to the interior of the side wall. The wall dams act to deflect the molten steel as it rebounds from the tundish bottom thus eliminating a turbulent flow pattern on the surface of the molten steel bath.

The dams are positioned within the tundish so that said flange portion is below the normal operating surface level of the molten metal, but above the midpoint of the depth of said molten metal in the tundish.

BRIEF DESCRIPTION OF DRAWINGS

FIG. 1 is a cross sectional view of a prior art tundish illustrating the turbulent flow pattern encountered during the pouring of molten metal therein. It should be noted that the typical tundish construction is an elongated trough-shaped vessel and that such FIGURE is a section through the shorter dimension.

FIG. 2 is a perspective view of a refractory dam for incorporation into a tundish, such as shown in FIG. 1.

DETAILED DESCRIPTION OF PREFERRED EMBODIMENT

Figure 3:
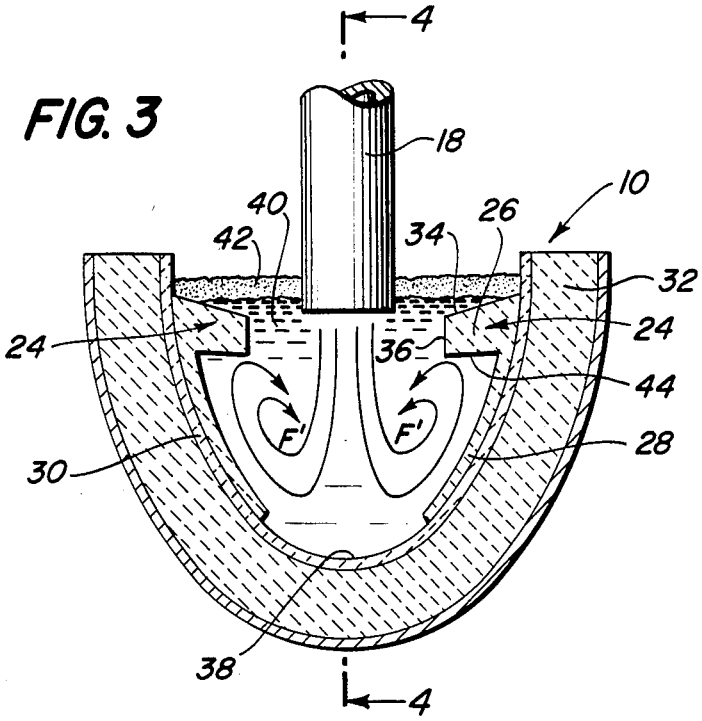
FIG. 3 is a cross sectional view of a tundish similar to FIG. 1, but incorporating the modification of the side wall dam shown in FIG. 2.

Before describing the unique construction of the tundish according to the teachings of this invention, it may be helpful to illustrate the problems of the prior art, which problems were overcome by this invention. Referring first to FIG. 1, tundish 10 is seen to comprise a trough-shaped vessel having refractory-lined side walls 12 covered with a replaceable refractory lining 14, a bottom portion 16, and two end walls (not shown). Steel flow lines F indicate the path that molten steel ordinarily follows as it is poured from a steelmaking ladle through ceramic shroud 18. Specifically, the molten steel flows downward and rebounds against bottom portion 16 of tundish 10. As the molten steel rebounds, it moves along the tundish lining 14 to the surface of the molten steel bath 20, creating a turbulent flow pattern thereon. This turbulent flow causes tundish flux cover 22 to disperse away from shroud 18. Such dispersion causes a portion of molten steel bath 20 to become exposed to the atmosphere and allows such bath 20 to interact with oxygen from the atmosphere. Such oxygen interaction, resulting in the formation of inclusions, reduces the internal cleanliness of the molten steel.

FIG. 2 illustrates the modified refractory wall dam 24 of this invention. Such dam 24, formed of a refractory material such as magnesium oxide, comprises a flange portion 26 and a curved vertical portion 28.

Figure 4:
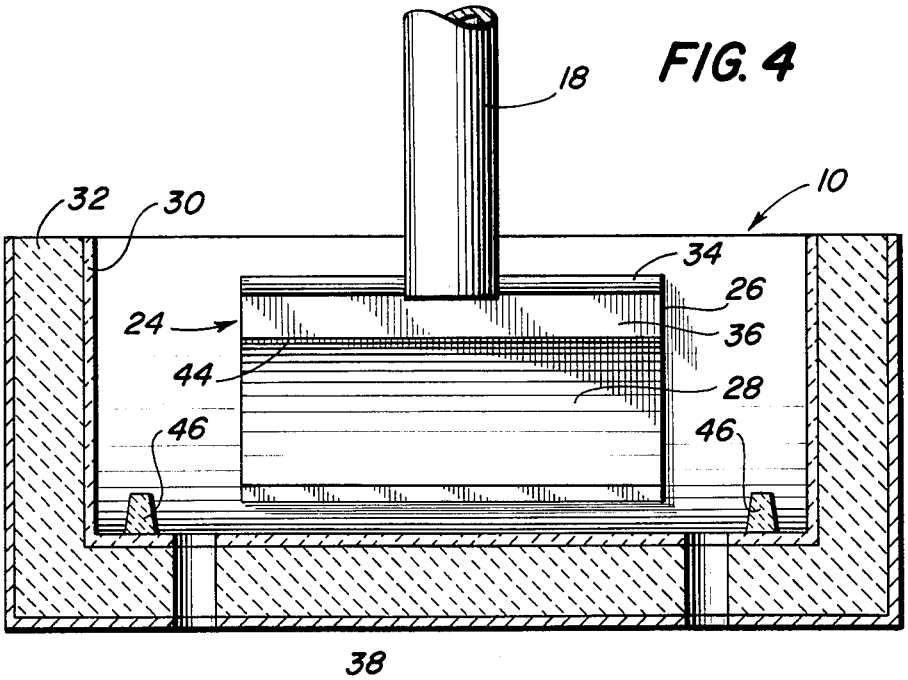
FIG. 4 is a longitudinal sectional view of the tundish illustrated in FIG. 3 in which the section is taken along the plane 4—4 shown in FIG. 3.

The function and features of the refractory wall dam 24 may be illustrated best by reference to FIGS. 3 and 4. The refractory wall dams 24 consist of the flange portion 26 and vertical portion 28, which may be formed as an integral part of the lining 30, or adapted to lie adjacent lining 30. Flange portion 26 projects substantially horizontally inwardly from side wall 32. The top surface 34 of flange portion 26 is tapered downwardly from side wall 32 to the edge 36 producing a flange 26 that is thickner where it joins the vertical portion 28. Steel flow lines F′ indicate that wall dams 24 deflect the molten steel and prevent it from rebounding from the bottom 38 to the surface of molten bath 40. As a result of this tundish design, turbulence is eliminated, and the flux cover 42 is not dispersed.

To be particularly effective in the elimination of such turbulence, the base or lower surface 44 of refractory wall dam 24 should be placed at a location that will reduce the flow velocity of the molten steel but not cause abnormal wear on wall dams 24. Accordingly, the preferred location should be below the normal or operating level of molten steel bath 40 but above the midpoint of the depth of molten steel bath 40. Thus, the optimum location for base 44 of wall dam 24 has been found experimentally to be a distance from bottom 38 of the tundish equal to two-thirds of the normal or operating depth of molten steel bath 40 or one-third the distance below the surface of the molten steel bath 40.

Insofar as the preferred lateral dimension of wall dam 24 is concerned, it should be apparent that the major impact of any turbulence is in the center of the tundish directly below shroud 18. Therefore, the preferred length of lateral dimension of wall dam 24 should be at least one-half of the lateral length of tundish 10. This is particularly the case when side dams 46 are incorporated into the construction of such tundish at a positon substantially midway between the end of the refractory dam member 24 and the face of the end wall lining 30.

We claim:

1. In a tundish for use in the continuous casting of a molten metal and comprising a curved bottom portion having one or more nozzles for transferring said molten metal into a mold, upstanding curved sidewalls and flat end walls to define an elongated trough containing a quantity of molten metal, the improvement comprising in combination therewith the provision of a refractory lining, each sidewall being provided with a refractory dam member, said dam member comprising a curved vertical portion positioned against said refractory lining and a flange portion projecting substantially horizontally inwardly and having a downwardly sloping upper surface, where said flanges are positioned below the operating surface level of said molten metal but above the midpoint of the depth of said molten metal in said tundish.

2. The tundish of claim 1 characterized further by the length of the refractory dam members along said sidewalls being less than the distance between said end walls.

* * * * *